US009622595B2

(12) United States Patent
Kozak et al.

(10) Patent No.: US 9,622,595 B2
(45) Date of Patent: Apr. 18, 2017

(54) MODULAR DISPLAY RACK WITH HEADER WITH A CONTOURED SURFACE

(76) Inventors: Burton Kozak, Chicago, IL (US); Ira Kozak, Riverwoods, IL (US)

( * ) Notice: Subject to any disclaimer, the term of this patent is extended or adjusted under 35 U.S.C. 154(b) by 730 days.

(21) Appl. No.: 12/810,935

(22) PCT Filed: Dec. 24, 2008

(86) PCT No.: PCT/IB2008/003624

§ 371 (c)(1),
(2), (4) Date: Jun. 28, 2010

(87) PCT Pub. No.: WO2009/087460

PCT Pub. Date: Jul. 16, 2009

(65) Prior Publication Data

US 2010/0288714 A1 Nov. 18, 2010

Related U.S. Application Data

(60) Provisional application No. 61/009,176, filed on Dec. 26, 2007, provisional application No. 61/125,101, filed on Apr. 22, 2008.

(51) Int. Cl.

| | |
|---|---|
| ***A47F 5/08*** | (2006.01) |
| ***G09F 3/00*** | (2006.01) |
| ***G09F 3/20*** | (2006.01) |

(52) U.S. Cl.

CPC ..... *A47F 5/0869* (2013.01); *G09F 3/204* (2013.01)

(58) Field of Classification Search

CPC ..... G09F 3/204; A47F 5/0869
USPC ..... 211/7, 57.1, 59.1, 59.2, 59.3, 59.4, 106, 211/113, 118, 119, 119.003; 248/220.22, 248/220.31, 220.41, 249; 40/642.02, 651, 40/661.03; D20/40, 43, 44

See application file for complete search history.

(56) References Cited

U.S. PATENT DOCUMENTS

| | | | | | |
|---|---|---|---|---|---|
| D106,230 | S | * | 9/1937 | Fawcett | D6/463 |
| 2,246,081 | A | * | 6/1941 | Van Nattan | 211/60.1 |
| 2,451,581 | A | * | 10/1948 | Slavsky et al. | 40/650 |
| 2,552,685 | A | * | 5/1951 | McCarthy | 40/651 |
| 2,802,576 | A | * | 8/1957 | Kelling | 211/59.1 |
| 2,984,031 | A | * | 5/1961 | Giesecke | 40/649 |
| 3,976,201 | A | * | 8/1976 | Hodgson et al. | 248/220.22 |
| 4,072,246 | A | * | 2/1978 | Paulin | 221/307 |
| 4,161,074 | A | * | 7/1979 | DePinna | 40/124.05 |
| 4,215,840 | A | * | 8/1980 | Babberl | 248/220.22 |
| 4,246,710 | A | * | 1/1981 | Mixer | 40/651 |
| 4,471,544 | A | * | 9/1984 | Nelles et al. | 40/649 |
| 4,591,057 | A | * | 5/1986 | Garfinkle | 211/59.1 |
| 4,606,466 | A | * | 8/1986 | Fredrickson | 211/59.1 |
| 4,865,205 | A | * | 9/1989 | Thorneburg et al. | 211/59.1 |
| D305,911 | S | * | 2/1990 | Burlando | D20/44 |

(Continued)

FOREIGN PATENT DOCUMENTS

DE 41 10 357 C1 1/1993

*Primary Examiner* — Joshua Rodden
(74) *Attorney, Agent, or Firm* — Factor Intellectual Property Law Group

(57) ABSTRACT

A display rack having a display header with a contoured surface to provide for an insert to be disposed proximate a product. The contoured surface may have a series of concave indentations, convex protrusions, a horizontal bending edge or a series of V-shaped protrusions or indentations. The display header may be retrofitted onto an existing display rack.

9 Claims, 9 Drawing Sheets

(56) References Cited

U.S. PATENT DOCUMENTS

| | | | | | |
|---|---|---|---|---|---|
| 5,120,941 | A * | 6/1992 | Reilley et al. | 235/375 | |
| D338,241 | S * | 8/1993 | Landa | D20/43 | |
| 5,833,077 | A * | 11/1998 | Engel | 211/59.1 | |
| 6,092,674 | A * | 7/2000 | Rothstein et al. | 211/59.1 | |
| D436,781 | S * | 1/2001 | Karsten et al. | D6/567 | |
| 6,360,465 | B1 * | 3/2002 | Simpson | 40/638 | |
| 6,786,340 | B2 * | 9/2004 | Ford | A47F 5/0815 | 211/103 |
| 7,419,062 | B2 * | 9/2008 | Mason | A47F 1/126 | 211/59.3 |
| 7,644,527 | B2 * | 1/2010 | Clark | A47F 5/137 | 211/206 |
| 2003/0168419 | A1 * | 9/2003 | Rodrigue | 211/59.1 | |

* cited by examiner

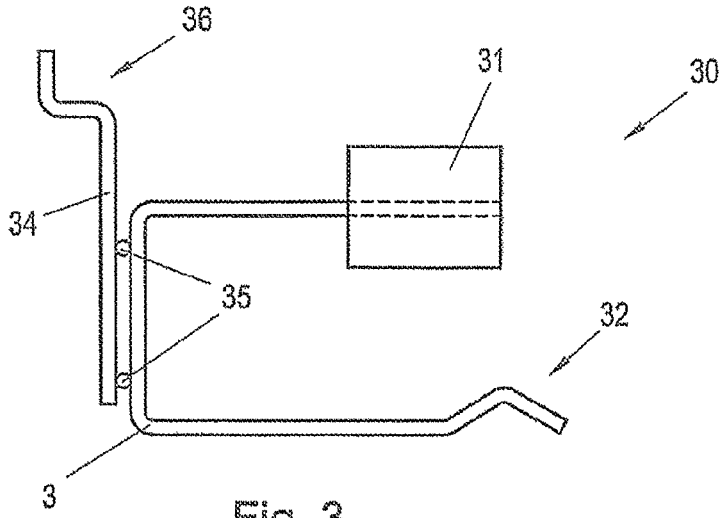
Fig. 3
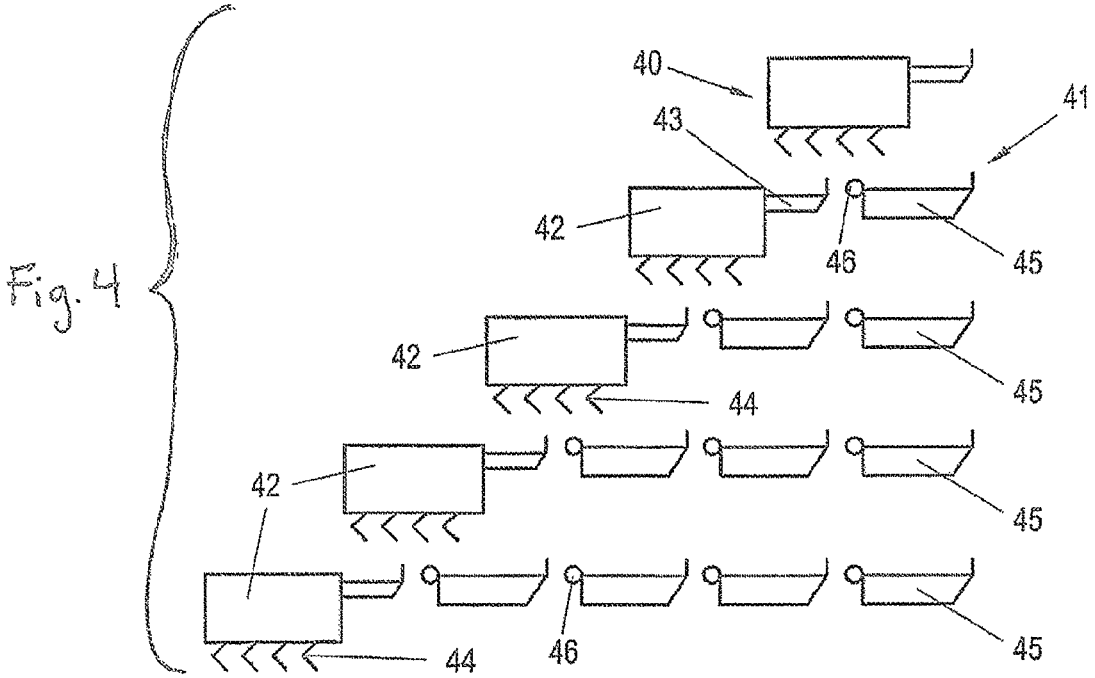

MODULAR DISPLAY RACK WITH HEADER WITH A CONTOURED SURFACE

RELATED APPLICATIONS

This application claims the filing benefit of International Patent Application No. PCT/IB2008/003624, filed Dec. 24, 2008, which claims the filing benefit of U.S. Provisional Patent Application No. 61/009,176 filed Dec. 26, 2007 and U.S. Provisional Patent Application No. 61/125,101, filed Apr. 22, 2008, the contents of all are incorporated herein by reference.

FIELD OF THE INVENTION

The present invention relates to displays and more particularly to a display rack with a header for providing product information.

BACKGROUND OF THE INVENTION

Retailers use display racks to place products for purchase by consumers. The display racks can allow for multiple products to be displayed and/or different products to be displayed. The display racks can often include a display header. The display header can be used to include product information on an insert disposed in the display header. The insert can be used for inventory control, ordering and pricing information and can include Universal Product Code (UPC) bars, or other similar information.

SUMMARY OF THE INVENTION

The present invention provides a display rack, which includes a plurality of members for displaying a product and a display header. The display header maximizes the area for an insert by providing a contoured surface. The contoured surface provides a greater surface area for the insert than a straight display header.

DESCRIPTION OF THE INVENTION

A modular display rack 10 according to the present invention includes a plurality of members 12 for displaying a product 14 and a display header 16, 100 disposed proximate thereto. The members 12 may be hooks, pegs, wires, loops, baskets, shelves, or any other structure capable of displaying, often by suspension, a product 14 (often in a package).

As mentioned above the display rack 10 also includes a display header 16, 100.

While the term "display header" is used, nothing herein should be construed as a limitation that the display header be located above the members 12; rather, the display header 16, 100 could be located below the members or for example in cases of baskets in front of the member.

The display header 16, 100 is located proximate the plurality of members 12 to associate a portion 18 of the display header with one or more members 12 from the plurality of members 12.

The display header 16, 100 has a contoured surface 20, 104. This contoured surface 20, 104 may have a series of concave indentations 22. Alternatively the contoured surface may have a series of convex protrusions. The contoured surface 200 may also comprise a horizontal bending edge. Alternatively, the contoured surface may comprise a series of groups of three vertical bending edges with altering bending directions resulting in V-shaped 20 protrusions 105 or indentations. Although not depicted, the contoured surface 20, 104 does not have to have smooth surfaces and can comprise a rough or ribbed surface. The contoured surface 20, 104 allows for a larger insert 24 to be disposed within the display header 16, 100.

It should be understood that the contoured surface 20, 104 is not limited to particular designs or shapes, and any surface that provides a surface area, which has a greater linear distance than the linear distance between the individual designs or shapes of the contoured surface 20, 104 will suffice. By way of example, in FIGS. 1*a* and 1*b*, the linear distance along the concave indentation 22*a* is greater than the distance between the adjacent concave indentations 22*b*, 22*c*. In other embodiments, the display header 16, 100 may also be non-curved, such as, zigzag. Moreover, the display header 16, 100 may also be a stepped header, that is, consumers can browse product labels by flipping; for example, there may be three stepped labels in the same area.

In addition, although not shown, the contoured surface 20, 104 may include one or more vertical contours as opposed to the horizontal contours shown in FIGS. 1 and 8.

The insert 24 can have an adhesive on the side that abuts the contoured surface 20, 104 of the display header 16, 100. Alternatively, the insert 24 can have some flexibility so that the insert 24 can be configured to be parallel to the shape of the contoured surface 20, 104 of display header 16, 100. Other attachment means are likewise contemplated.

DESCRIPTION OF THE DRAWINGS

FIG. 3 is side view of a display rack module with a member for displaying the product and the display header.

FIG. 4 is a schematic drawing of a modular rack system according to the present invention.

DETAILED DESCRIPTION OF THE PREFERRED EMBODIMENTS

Figure 1A:
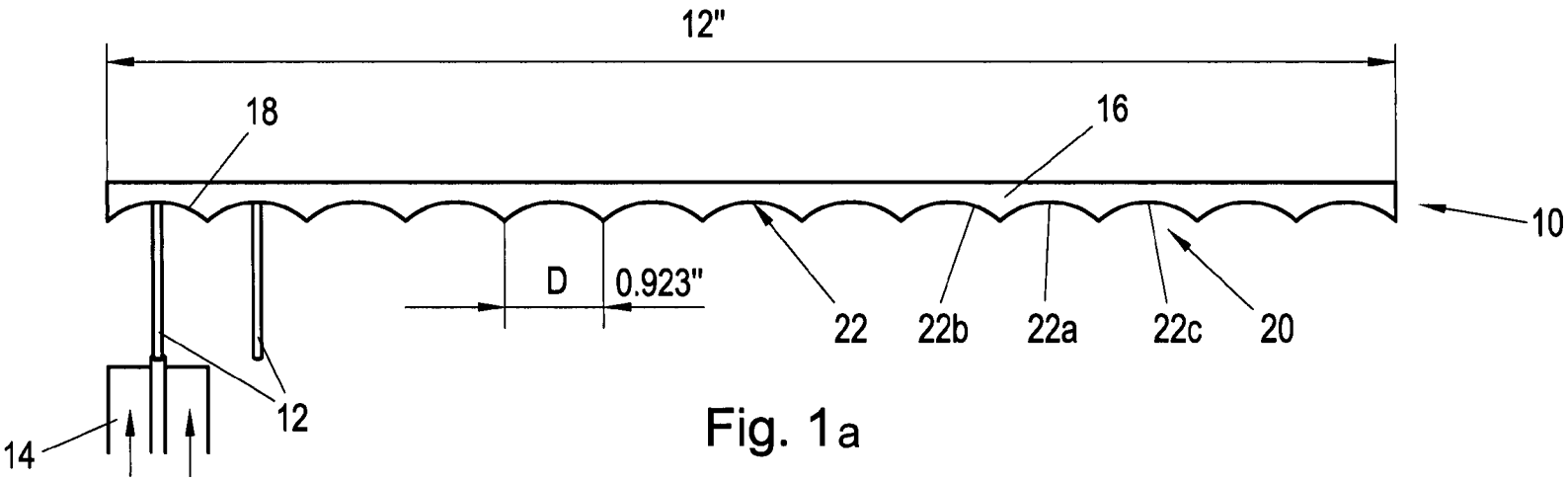
FIGS. 1*a* and 1*b* area top views of a display header with concave indentations according to the present invention.

In at least one embodiment of the invention the display header 16, 100 measures twelve inches of width, two of height, and has thirteen concave indentations 22 (each having a chord D measuring 0.923 inches resulting in a circular arc of 1.25 inches) or thirteen convex protrusions (each having a chord measuring 0.923 inches resulting in a circular arc of 1.25 inches). The inserts 24 disposed in the concave indentations 22 or on the convex protrusions have a width of 1.25 inches. This allows for an insert 24 with more information to be located near the product 14. Moreover, the height of the display header 16, 100 is long enough for two rows of inserts 24; for example, the display header is 2.5 inches tall and the label is 1.25 inches wide.

In another embodiment of the invention, the display header 16, 100 measures twelve inches of width, four inches of height, and comprises contoured surface 20, 104 with horizontal bending edge virtually separating the header 16, 100 symmetrically or asymmetrically into two. This allows two inserts 24 to be located near the product 14.

Figure 8:
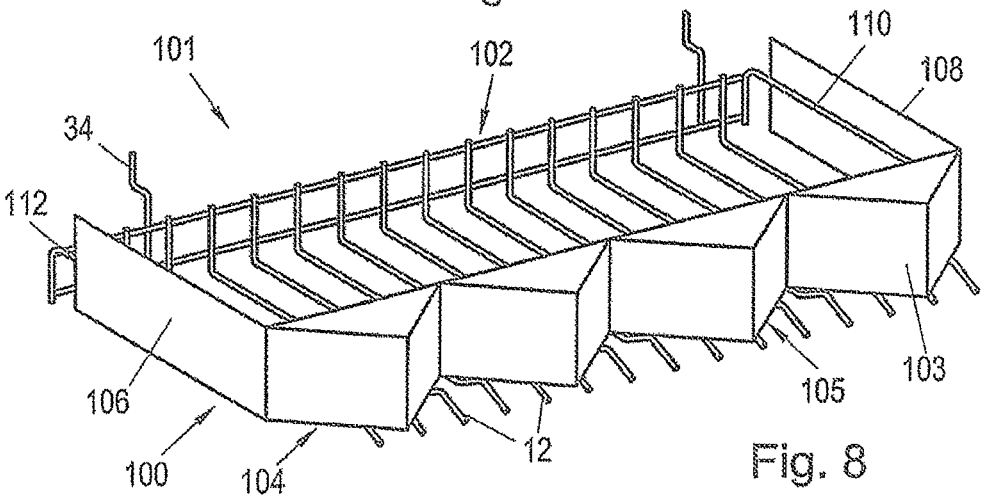
FIGS. 8 and 9 show a module of a modular display rack system with a display header with 4 V-shaped protrusions.

In another embodiment of the invention e.g. according to FIG. 8, the display header measures twelve inches of width and two and a half of height. The display header comprises a series of V-shape protrusions or indentions due to vertical bending edges with altering bending directions within the material of the header, e.g. a metal strip. The arms of the V-shaped protrusions or indentions have a length of two inches. This allows two inserts to be located on less width on the display rack. This might be two inserts concerning one or two products, depending on the location of the portion 18 of the display header 16, 100 in respect to the members 12 of the plurality of members 12 for displaying a product 14.

In another embodiment of the invention, the display header 16, 100 measures twelve inches of width and one and a half inches of height. The display header 16, 100 comprises a contoured surface 20, 104 with a series of V-shape protrusions 105 or indentions due to vertical bending edges with altering bending directions within the material of the header, e.g. a metal strip. The arms of the V-shaped protrusions 105 or indentions have a length of two inches. This allows two inserts 24 to be located on less width on the display rack.

In another embodiment of the invention, the angled corners of the V-shaped protrusions 105 protrude one and a quarter inches from the base line of the display header 16, 100 in a top view of the display header 16, 100.

In another embodiment of the invention, the display header 16, 100 comprises four V-shaped protrusions 105.

In another embodiment of the invention, the display header 16, 100 comprises seven V-shaped protrusions 105.

In another embodiment of the invention, the base line of the display header 16, 100 in a top view of the display header 16, 100 is one and a quarter inches away from the front of the rack.

In another embodiment of the invention, the header signage is spot-welded on five places.

In another embodiment of the invention, the bottom of the display header 16, 100 is two and a half inches above the plurality of members 12 for displaying a product 14

In another embodiment of the invention, the bottom of the display header 16, 100 is one inch above the plurality of members 12 for displaying a product 14.

In another embodiment of the invention, the plurality of members 12 for displaying a product 14 comprises fourteen hooks.

Figure 9:
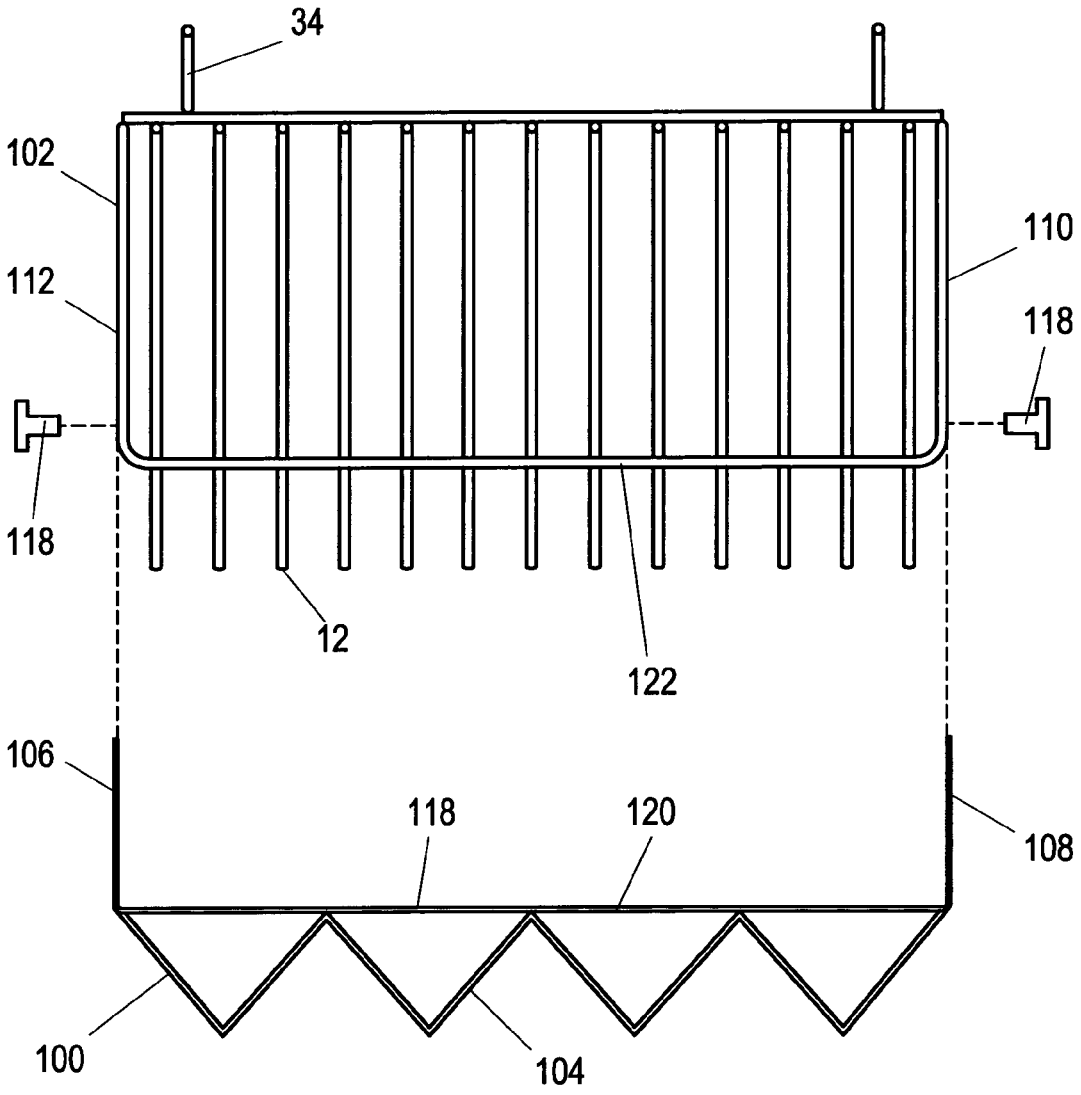

It is also contemplated, according to FIG. 8, that a display header 100 be retrofitted to already existing display rack 102. The display header 100 may have a contoured surface 104. As shown in FIG. 9, The display header 100 may be affixed to the display rack 102 with pins 118 cooperating with two attachment extensions 106, 108 of the display header 100 and the two sides 110, 112 of the display rack 102. Additionally or alternatively, the display header 100 may be affixed to the display rack 102 with an adhesive strip on rear surface 120 of the display header 100 attaching to the display surface 122 of the display rack 102. Other methods of attaching known to those of skill in the art can be used, including, but not limited to, glue, welding, spot welding, chemical adhesion, screws, nuts and bolts, clips, or any other means.

Figure 1B:
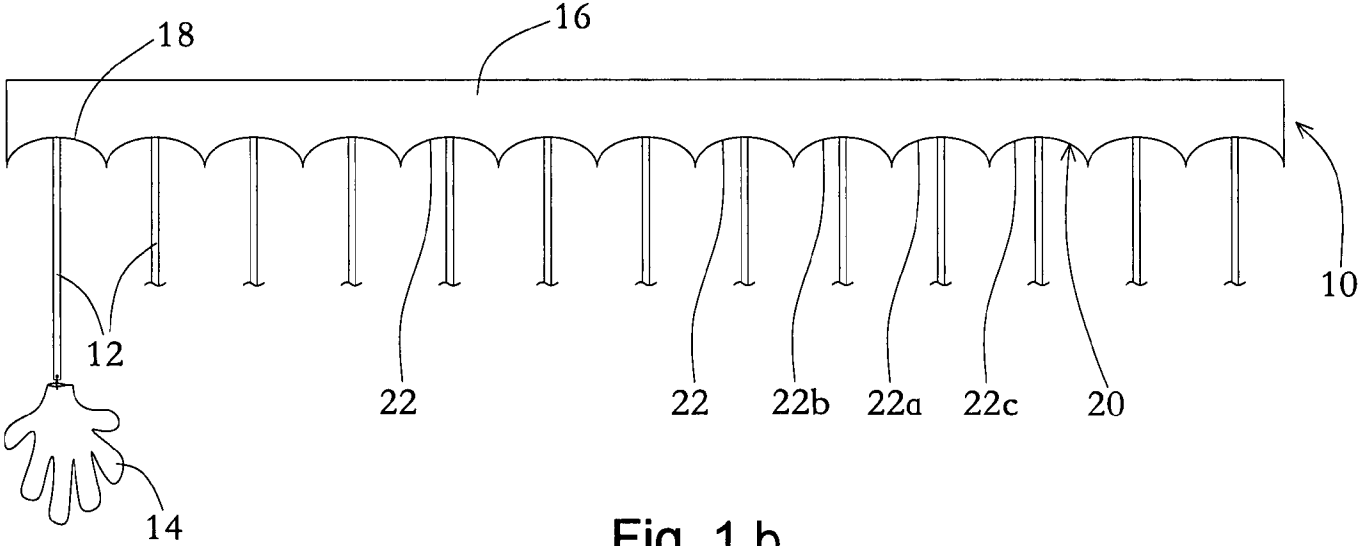

FIGS. 1*a* and 1*b* show a top view of a display rack 10 with a display header 16 measuring twelve inches of width with a contoured surface 20 comprising a series of concave indentations 22. The chord D of the concave indentations in this embodiment of the invention measures 0.923 inches resulting in a circular arc of 1.25 inches. The contoured surface is not limited to this geometry of the indentions, e.g. in another embodiment of the invention the distance D along the concave indention 22*a* is greater than the distance between the adjacent concave indentions 22*b*, 22*c*. A portion 18 of the display header 100 associates with one or more members 12 from the plurality of members 12.

Figure 2:
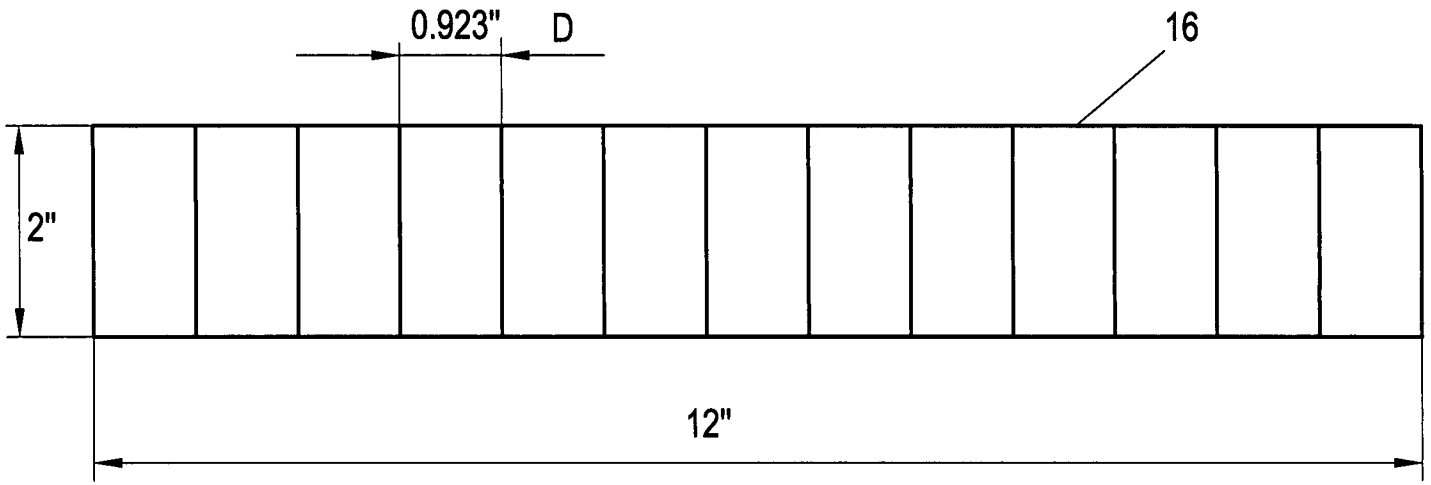
FIG. 2 is a front view of a display header with concave indentations according to FIGS. 1*a* and 1*b*.

FIG. 2 shows a front view of a display header 16 according to FIGS. 1*a* and 1*b* measuring two inches of height and 12 inches of width. The concave indentations have chords D each measuring 0.923 inches.

FIG. 3 shows a side view of a display rack module 30 according to the present invention. The presentation unit of the module 3 comprises an upper part for attaching the display member 31 and a lower part forming a hook 32 displaying the member. The presentation unit 3 is attached to the mounting unit 34 of the module via spot-welding 35. The mounting unit of the display rack module comprises a hook-like structure for mounting the module to a backbone system of a display rack system.

FIG. 4 shows a schematic drawing of a modular rack system according to the present invention wherein 46 is a tube, slot, and/or loop to interlock devices 41 with extensions 45 of the rack system 40, in particular a modular rack system using peg hooks 36 according to FIG. 3 on back of a rack. Additionally FIG. 4 shows further extensions 42 and attaching units 43 with supplementary attaching devices 44. Furthermore the extensions 45 allow the racks to be used in a waterfall function, allowing greater visibility while racks be moved closer together. This means a first rack is attached to the peg board, a second rack is attached to the first rack, a third rack is attached to the second rack, and so on.

Figure 5:
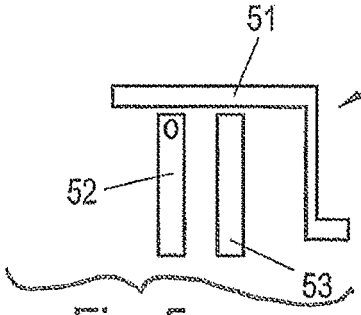
FIG. 5 shows parts of a modular display rack system.
Figure 6:
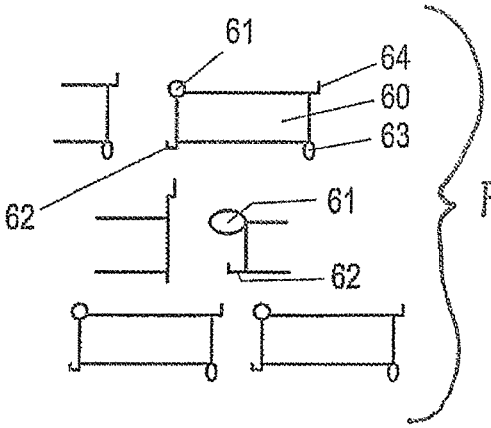
FIG. 6 shows parts of a modular display rack system.

FIG. 5 shows parts of a modular display rack system and FIG. 6 shows parts of a modular display rack system wherein 50 is the display rack module, 51*a* member to present the products 52 and 53. 60 is an interlock extension with hooks 62, 64 and tube, slot, loops 61, 63 to interlock extensions.

Figure 7:
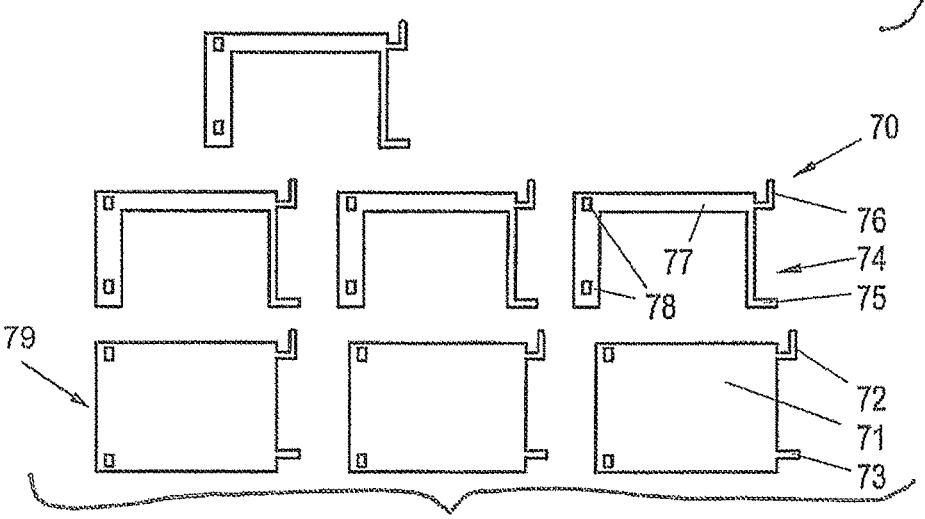
FIG. 7 shows parts of a modular display rack system.

FIG. 7 shows parts of a modular display rack system wherein the top portion formed from wire 70 and the bottom portion 79 formed from a sheet of metal or moulded plastics, wood or other sheet materials 71 is shown. The top portion comprises hooks 75, 76 an interlock connecting unit 74, extending device 77 and tubes, slots, and/or loops 78 to interlock the extensions. The bottom portion 79 also shows tubes, slots, and/or loops 72, 73 to interlock the extensions FIGS. 8 and 9 show one module 101 of a modular display rack system according to the present invention. The display header 100 is attached with the attachment extensions 106, 108 to the two sides 110, 112 of the display rack 102. The display header 100 comprises a contoured surface 104 with four V-shaped protrusions 105 with the side-faces 103. The display header 100 is located approximate to the plurality of members 12 for displaying a product 14. The display rack 102 comprises two mounting units 34, which allows the location of the display rack module 101 to a backbone system of a display rack system.

As shown in FIGS. 8 and 9, another embodiment of the present invention includes a display rack 102 that has been retrofitted with a display rack header 100 according to the present invention. The display header 100 is attached with the attachment extensions 106, 108 to the two sides 110, 112 of the display rack 101 to form the display rack 102. The display header 100 comprises a contoured surface 104 with four V-shaped protrusions 105 (in other words a zigzag pattern) with the side-faces 103. The display header 100 is located proximate to the plurality of members 12 for displaying a product 14. The display rack 102 includes two mounting units 34.

Figure 10:
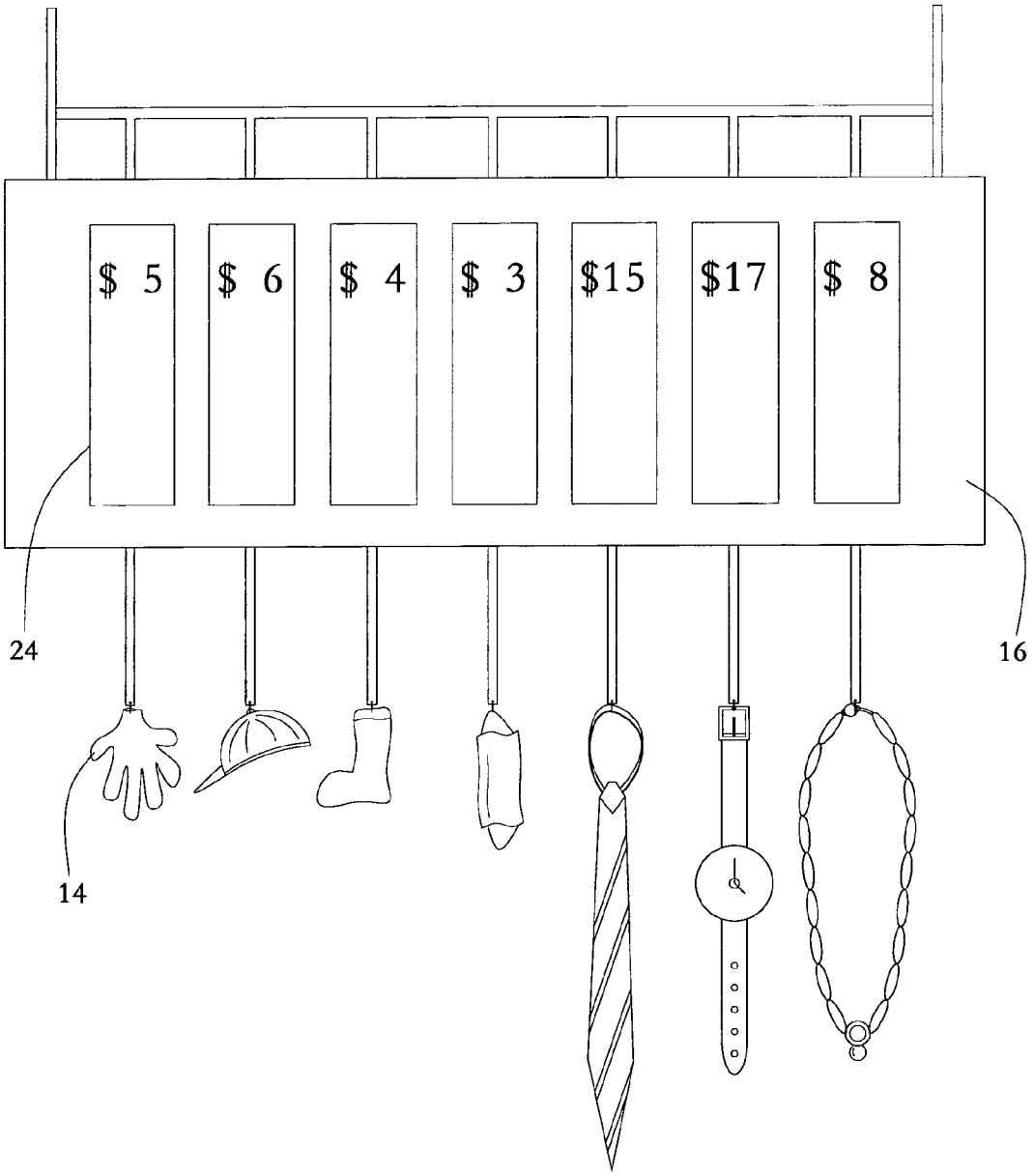
FIG. 10 is front view of a display rack with products and inserts.
Figure 11A:
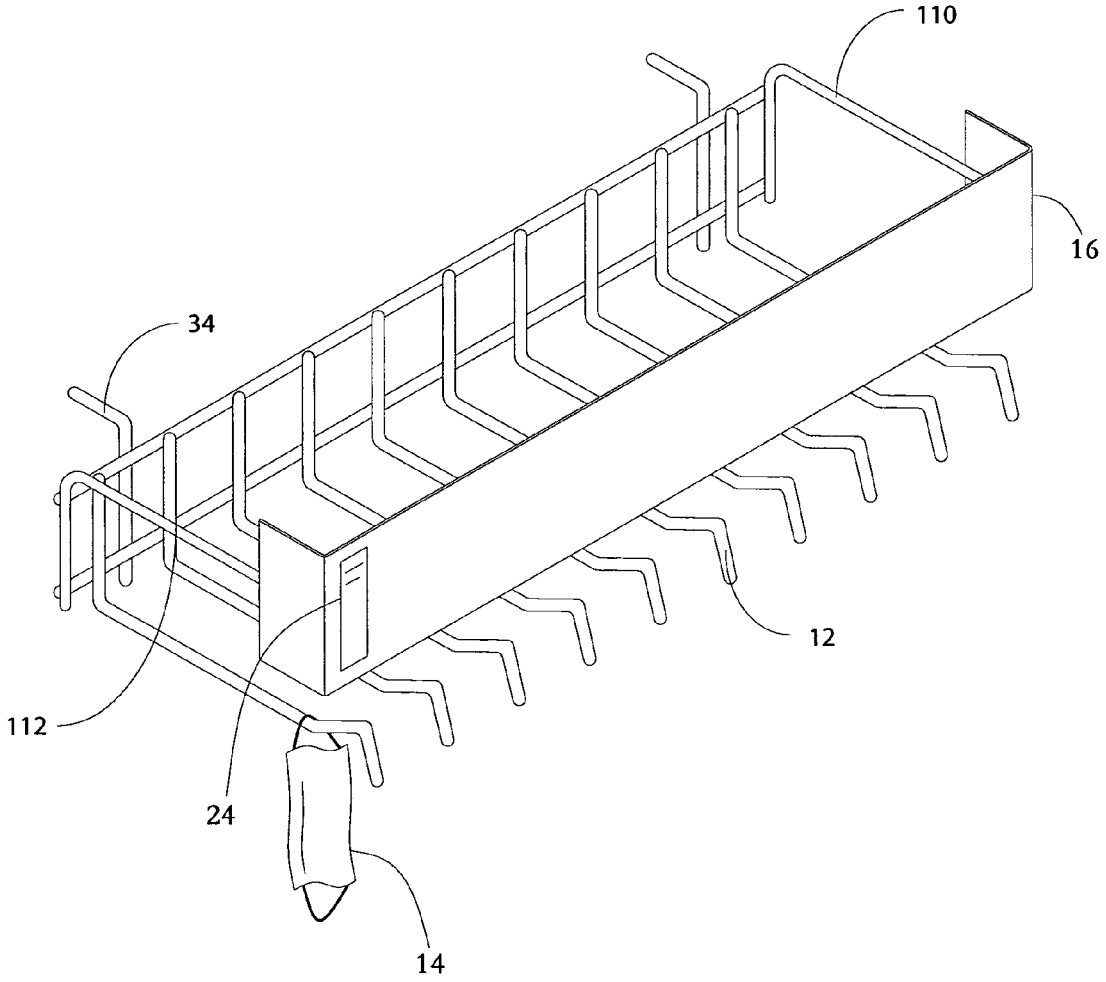
FIG. 11*a* is a side perspective view of a display rack.
Figure 11B:
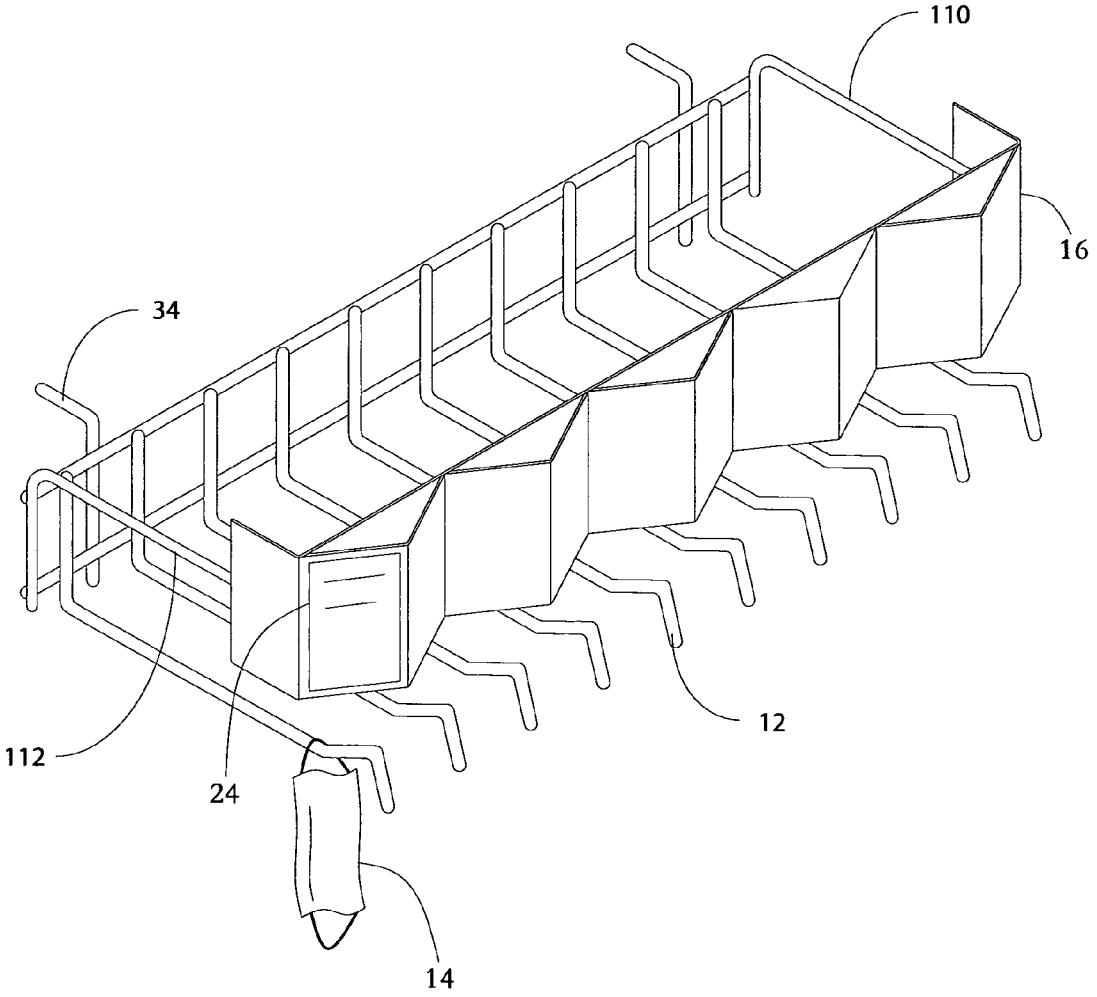
FIG. 11*b* is a side perspective view of a curved display header rack.

FIG. 10 shows a front view of a display rack with products and inserts and FIG. 11*a* is a side perspective view of a display rack. FIG. 11*b* is a side perspective view of a curved display header rack. Beside the display header 16 and the inserts 12, FIGS. 11*a*, 11*b* and 12 show the mounting units 34, the two sides 110 and 112 of the display rack and the displaced products 14.

Figure 12:
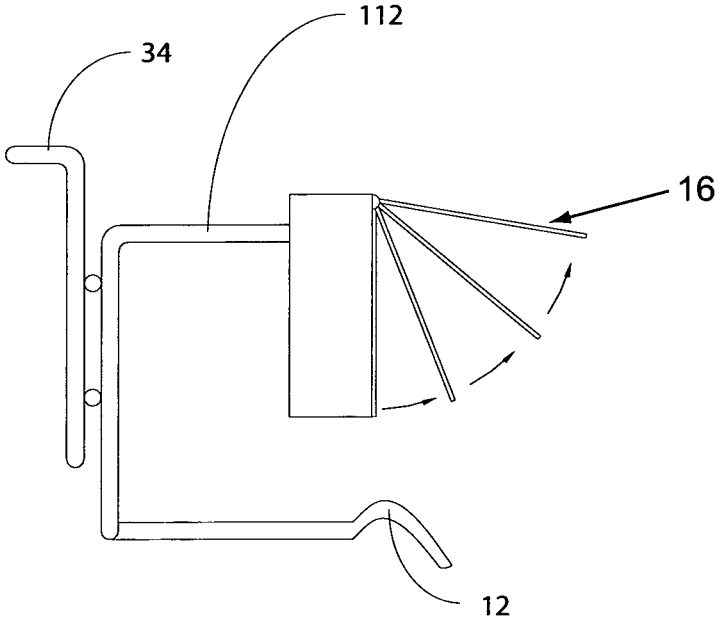
FIG. 12 is a side perspective view of stepped display header rack.

As shown in FIG. 12 the display header 16, 100 may also be a stepped header, that is, consumers can browse product labels by flipping; for example, there may be three stepped labels in the same area.

The invention claimed is:

1. A display rack comprising:

a plurality of hooks for displaying a product; and, a display header having a contoured surface disposed proximate the plurality of hooks, wherein the display header comprises at least two indentions and at least two protrusions which are formed by vertical bending edges separated by side-faces forming a V-shape and facing a direction outward from the plurality of hooks so as to form a product information display for the display header, wherein each side-face has at least one hook from the plurality of hooks vertically aligned therewith.

2. The display rack of claim 1, wherein the display header includes a height of 2.5 inches to accommodate two rows of labels.

3. The display rack of claim 1, wherein the display header is retrofitted over an existing display header.

4. The display rack of claim 3 wherein the display rack further comprises mounting units.

5. The display rack of claim 3 wherein the contoured surface comprises a zigzag surface.

6. The display rack of claim 5 wherein the display header also includes attachment extensions.

7. A display rack comprising:

a plurality of hooks for displaying a product;

a display header disposed proximate the plurality of hooks wherein the display header has a width of approximately twelve inches, and a display surface having a linear distance greater than twelve inches, wherein the display surface includes at least two indentions and two protrusions forming a product information display area, each indention or protrusion being formed as a vertical bending edge between two side-faces and further wherein, each side-face has at least one hook from the plurality of hooks vertically aligned therewith; and, at least two peg hooks for mounting the display rack in a peg board.

8. The display rack of claim 7, wherein the plurality of hooks includes 14 hooks.

9. The display rack of claim 7, wherein a height of the display header is between approximately 2 to approximately 4 inches.

* * * * *